United States Patent [19]

Valiant

[11] 4,454,897

[45] Jun. 19, 1984

[54] KETCHUP BOTTLE SUPPORT

[76] Inventor: Dimitri Valiant, 1729 Bayview Dr., Erie, Pa. 16505

[21] Appl. No.: 423,614

[22] Filed: Sep. 27, 1982

[51] Int. Cl.[3] ..... B67C 9/00

[52] U.S. Cl. ..... 141/364

[58] Field of Search ..... 24/9, 15, 17 A, 20 EE, 24/23 R, 23 B, 23 W, 23 EE; 99/644; 141/1, 98, 311 R, 319, 328, 332, 340, 341, 342, 343, 363, 364, 384, 391, 392; 229/21, 37 R, 37 E; 215/100 R; 248/74 B, 94, 248, 312, 313; 285/183, 332.1, 334.5, 417, 420, 424; 211/73; 248/152, 174

[56] References Cited

U.S. PATENT DOCUMENTS

| | | | |
|---|---|---|---|
| 732,936 | 7/1903 | Graeme | 215/100 R |
| 3,028,032 | 4/1962 | Jones | 141/364 |
| 3,615,150 | 10/1971 | Indrunas | 141/364 X |
| 4,347,879 | 9/1982 | Blaser | 141/364 |

*Primary Examiner*—Stephen Marcus
*Assistant Examiner*—Mark Thronson
*Attorney, Agent, or Firm*—Charles L. Lovercheck; Wayne L. Lovercheck; Dale R. Lovercheck

[57] ABSTRACT

A device for holding two ketchup bottles in mouth to mouth relation to empty the ketchup from one to the other is disclosed. The holder is made of a flat sheet of flexible material such as cardboard or thin plastic with diamond shaped slots in it so that the sheet can be formed into an hour glass shaped configuration. One ketchup bottle can be inserted in one end of the configuration and the other can be inverted and inserted in the other end bringing the bottles into mouth to mouth relation with each other so that the remaining ketchup in one bottle can be emptied into the other bottle.

5 Claims, 2 Drawing Figures

KETCHUP BOTTLE SUPPORT

GENERAL STATEMENT OF THE INVENTION

A bottle holder is disclosed for supporting ketchup bottles in mouth to mouth relation. Ketchup bottles in commercial eating houses are often partially emptied and the remaining ketchup in the bottles is difficult to dispose of. Applicant has discovered that by providing an hour glass shaped support made of a sheet of plastic material held into the shape of the hour glass so that two ketchup bottles can be supported one on each end of the hour glass shaped configuration so that the bottles are brought into mouth to mouth relationship with each other and the ketchup remaining in the upper bottle will drain into the lower bottle without any substantialy loss of ketchup. The sheet of material is preferably stamped and held in hour glass shape by a band provided to draw the central part of the configuration together to snugly receive the small ends of the bottles and thereby holding them together.

OBJECTS OF THE INVENTION

It is an object of the invention to provide an improved support for and inverted bottle for empyting the contents of one bottle into another.

Another object of the invention is to provide a support for bottles that is simple in construction, economical to manufacture and simple and efficient to use.

Another object of the invention is to provide an improved holder for ketchup bottles.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

DETAILED DESCRIPTION OF THE DRAWINGS

Figure 2:
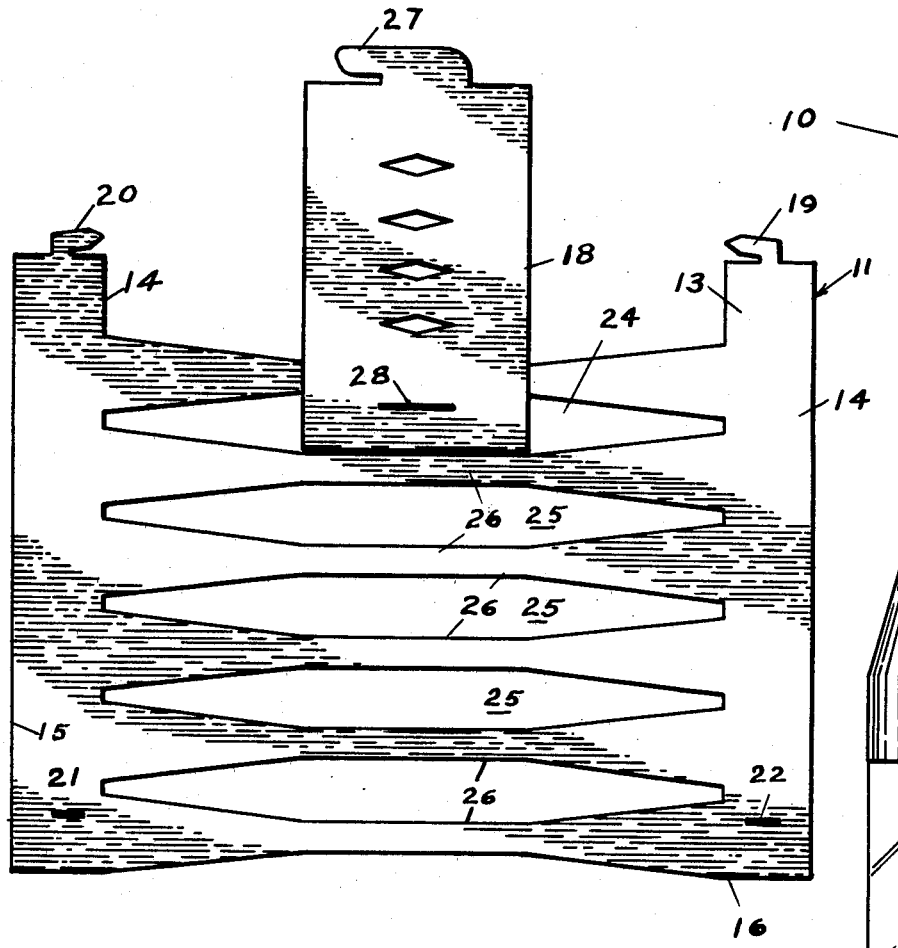
FIG. 2 is a view of the bottle holder unassembled to a bottle.
Figure 1:
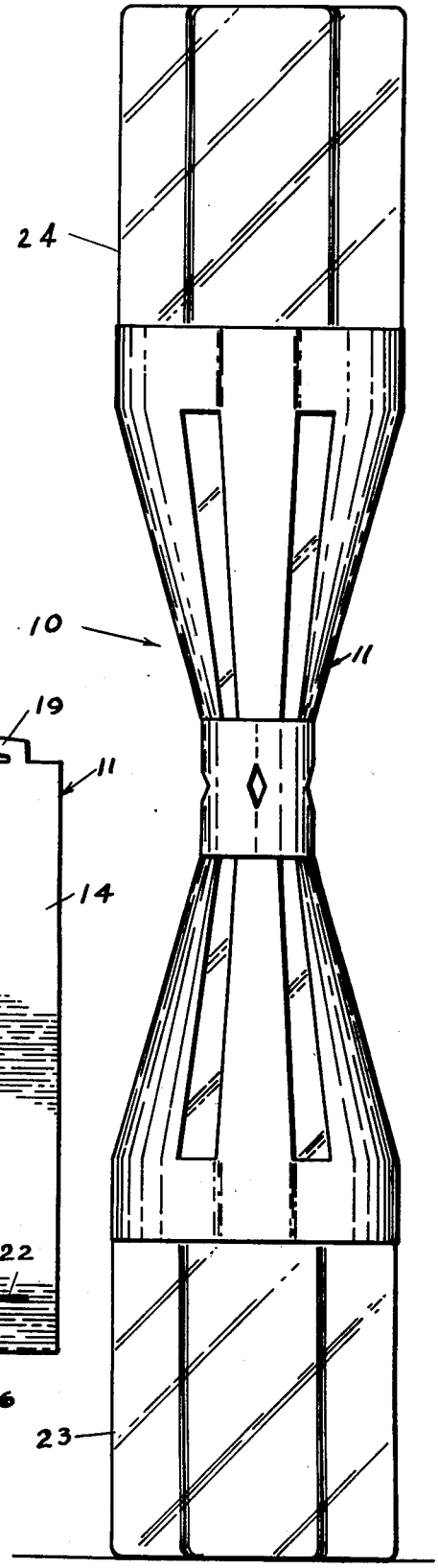
FIG. 1 is a side view of the ketchup bottle holder showing two bottles supported in it and on a countertop or the like as for use.

Now, with more particular reference to the drawings, in FIG. 1, I show a bottle holder 10, a sheet of flexible material 11 having generally parallel sides 14 and 15, a first end 16 and a second end 17. The length of the sheet between the first end 16 and the second end 17 is approximately equal to the major circumference of the bottle to be supported in it. One end of the sheet has the band 18 fixed to it by pressure sensitive adhesive or some other suitable fastening means and tabs 12 and 13 are integrally attached to the second end. The tabs have hooks 19 and 20 respectively fixed to their ends and these hooks are adapted to be received in the recesses 21 and 22 for holding the major length of the holder around the larger circumference of the bottles 23 and 24. The bottles 22 and 23 shown in the drawings are the conventional type of ketchup bottle found in most restaurants, however, these bottles could be any size or configuration and the sheet of flexible material would be made of sufficient length to receive the bottles in the manner that the bottles 23 and 24 are received in FIG. 2.

The band 18 is made of a length approximately equal to the circumference of the necks of the bottles 23 and 24 so that when the band 18 is wrapped around the intermediate part of the bottle the slots 25 are squeezed together so that the straight sides 26 of the slots are brought into close proximate relation to each other.

When the band 18 is wrapped around the necks of the bottles the hook 27 is received in the slot 28 of the band thereby holding it in relation to each other.

It is noted that instead of hooks 19, 20, and 27 other types of fastening means could be provided such as snap fasteners or pressure sensitive adhesive or Velcro. It will be noted that the sides 26 defining the slots are spaced from each other a sufficiently great amount that the straight intermediate sides 26 between the slots can be disposed in close spaced relation to each other.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A ketchup bottle holder to support one ketchup bottle on another, a flat sheet adapted to be formed to be supported on a first bottle on a counter top or the like, said first bottle having a major circumference and having a neck having a length and a minor circumference and a second bottle having a major circumference and having a neck with a length and minor circumference inverted above the first bottle in mouth to mouth relation with each other, comprising a generally flat rectangular sheet having two generally parallel sides a first end and a second end, an intermediate part between the ends of a length approximately equal to the major circumference of said bottles, laterally extending slots in said rectangular sheet, said slots being generally diamond shaped having a width sufficiently great that the sum of the widths of said slots is greater than the difference between the circumference of the neck of each of said bottles and the major circumference of said bottles and a band attached to the intermediate part of said sheet, said band having a distal end and a first end and a length approximately equal to the minor circumference of the necks of said bottles and a width approximately equal to the width of said bottle necks and means for attaching the distal end of said band to said first end of said band whereby the band can be wrapped around said sheet holding said sheet in the general shape of an hour glass for receiving one said bottle in the lower end thereof and the other said bottle inverted in the upper end thereof whereby the contents of the upper bottle will flow into the lower bottle.

2. The bottle holder recited in claim 1 wherein said attaching means comprises a hook on the distal end of the band and a recess in the first end of said band whereby the hook can be inserted in said recess holding the ends of said bands together around said bottles.

3. The bottle holder recited in claim 2 including means on the sides of said sheet for holding said sheet around the bottles said holding means comprising hooks adjacent a first side and slot in the second side for receiving said hooks to hold said bottle holder in generally hour glass shape.

4. The bottle holder recited in claim 2 wherein said bottles have a generally cylindrical lower portion, a frustoconical shaped intermediate portion and a generally cylindrical neck portion, said slots in said sheet have diverging straight sides adjacent one edge, and two straight generally parallel sides intermediate said diverging sides, said straight intermediate sides being substantially equal to the width of said band whereby said bottle holder can be supported on said first bottle, with the inclined diverging portions of said slot sides disposed over the generally frustoconical portions of said bottles and the intermediate straight portions disposed over the generally cylindrical necks of said bottles.

5. The bottle holder recited in claim 4 wherein said sheet terminates adjacent each side in elongated tab portions, said hooks are attached to the outer edges of said tab portions, said tab portions overlying the second end of said bottle holder sheet when said bottles are received therein whereby the second side of said sheet is held adjacent said first side thereof.

* * * * *